US008384304B2

(12) United States Patent
Hung et al.

(10) Patent No.: US 8,384,304 B2
(45) Date of Patent: Feb. 26, 2013

(54) LED DRIVER CONTROLLER

(75) Inventors: Chia-Chieh Hung, Taipei (TW); Yen-Hui Wang, Taipei (TW); Ko-Yen Lee, Taipei (TW); Wei-Chuan Su, Taipei (TW)

(73) Assignee: Immense Advance Technology Corp., Neihu District, Taipei (TW)

( * ) Notice: Subject to any disclaimer, the term of this patent is extended or adjusted under 35 U.S.C. 154(b) by 219 days.

(21) Appl. No.: 12/861,549

(22) Filed: Aug. 23, 2010

(65) Prior Publication Data

US 2012/0043908 A1 Feb. 23, 2012

(51) Int. Cl.
*H05B 37/02* (2006.01)

(52) U.S. Cl. ..... 315/291

(58) Field of Classification Search ..... None
See application file for complete search history.

(56) References Cited

U.S. PATENT DOCUMENTS 8,089,216 B2 * 1/2012 Negrete ..... 315/294
8,093,826 B1 * 1/2012 Eagar et al. ..... 315/291

* cited by examiner

*Primary Examiner* — Crystal L Hammond
(74) *Attorney, Agent, or Firm* — Shimokaji & Associates P.C.

(57) ABSTRACT

A novel LED driver controller, including: an auto-gain control unit, having an input end coupled to an input voltage signal which is derived from a line voltage, and an output end for providing a normalized signal; a comparator, used to perform voltage comparison on the normalized signal and a current sensing signal to generate a turn-off signal, wherein the turn-off signal will change state from inactive to active when the current sensing signal reaches the normalized signal; and a driving circuit, having a set input end, a reset input end, and an output end, the set input end being coupled to a turn-on signal, the reset input end being coupled to the turn-off signal, the output end being used for providing a gating signal.

9 Claims, 5 Drawing Sheets

LED DRIVER CONTROLLER

BACKGROUND OF THE INVENTION

1. Field of the Invention

The present invention relates to a LED driver controller, and more particularly to a LED driver controller capable of providing power factor correction and zero current switching for LED lighting applications.

2. Description of the Related Art

In a LED lighting application utilizing an AC power source, the load current for a LED module has to be regulated to not only provide a stable lighting but also protect the LED module.

FIG. 1 illustrates a prior art LED driver circuit. As illustrated in FIG. 1, the LED driver circuit, powered by a line voltage $V_{DC}$, a DC voltage, includes a LED driver controller 100, an NMOS transistor 101, an inductor 102, a diode 103, a resistor 104, a capacitor 105, and a LED module 110.

The LED driver controller 100, biased by $V_{DC}$, is used to generate a gating signal $V_G$ in response to a current sensing signal $V_{CS}$ in a way that the duty ratio of the gating signal $V_G$ becomes larger/smaller as the current sensing signal $V_{CS}$ goes down/up.

The NMOS transistor 101 is driven by the gating signal $V_G$ to control the power conversion of the LED driver circuit.

The inductor 102 is used to store a magnetic energy when the NMOS transistor 101 is on, and the diode 103 is used to release the magnetic energy to the LED module 110 when the NMOS transistor 101 is off.

The resistor 104 is used to generate the current sensing signal $V_{CS}$ according to a load current $I_L$.

The capacitor 105, a filtering capacitor, is used in cooperation with a full-wave rectifier (not illustrated in FIG. 1) to provide the DC voltage $V_{DC}$.

When in operation, the peak of the load current $I_L$ will be regulated at a constant value and the LED module 110 will thereby produce a regulated illumination.

However, there are some disadvantages in the prior art LED driver circuit. First, as the AC component of a full-wave rectified voltage output from a full-wave rectifier is filtered out by the capacitor 105, there is no way to perform power factor correction therein. Second, as the LED driver controller 100 cannot get the information of the end time of the discharging of the inductor 102, it cannot perform soft switching on the NMOS transistor 101 and this can cause EMI problem.

In view of the disadvantages of the prior art LED driver circuit, the present invention proposes a novel LED driver controller for a LED driver circuit, which can perform not only power factor correction but also zero current switching when regulating the current of a LED module.

SUMMARY OF THE INVENTION

One objective of the present invention is to propose a novel LED driver controller for a LED driver circuit, which can also perform power factor correction when regulating the current of a LED module.

Another objective of the present invention is to propose a novel LED driver controller for a LED driver circuit, which can also perform zero current switching to reduce EMI when regulating the current of a LED module.

To achieve the foregoing objectives of the present invention, a novel LED driver controller is proposed, the controller including: a boundary detection unit, a turn-on signal generator, an OR gate, an auto-gain control unit, a comparator, a driving circuit, and an NMOS transistor.

The boundary detection unit has an input end coupled to an input voltage signal which is derived from a line voltage, and an output end for providing a first turn-on signal which is generated according to voltage comparison of the input voltage signal and a threshold signal, wherein the threshold signal is a ratio of a sampled voltage of the input voltage signal at a rising edge of a turn-off signal, and the first turn-on signal will change state from inactive to active when the input voltage signal falls below the threshold signal.

The turn-on signal generator is used to generate a second turn-on signal, which can be a constant-frequency signal or a constant-off-time signal, wherein the constant-off-time signal is generated with reference to the turn-off signal.

The OR gate has a first input end coupled to the first turn-on signal, a second input end coupled to the second turn-on signal, and an output end for providing a turn-on signal.

The auto-gain control unit has an input end coupled to the input voltage signal, and an output end for providing a normalized signal, wherein the normalized signal is generated by detecting the amplitude of the input voltage signal and dividing the input voltage signal with the amplitude. As such, the amplitude of the normalized signal is a constant, no matter what the amplitude of the input voltage signal is.

The comparator is used to perform voltage comparison on the normalized signal and a current sensing signal to generate the turn-off signal, wherein the turn-off signal will change state from inactive to active when the current sensing signal reaches the normalized signal.

The driving circuit has a set input end coupled to the turn-on signal, a reset input end coupled to the turn-off signal, and an output end for providing a gating signal, wherein the gating signal is active when the turn-on signal is active, and inactive when the turn-off signal is active.

The NMOS transistor has a gate terminal coupled to the gating signal, a drain terminal for inflow of a load current provided by the line voltage, and a source terminal coupled to the current sensing signal, wherein the current sensing signal is proportional to the load current.

When the LED driver controller of the present invention is operating in a LED driver circuit, the peak of the current sensing signal and therefore the peak of the load current will be regulated at the normalized signal. If the line voltage is a full-wave rectified result of an AC power and the input voltage signal is proportional to the line voltage, then as the peak of the load current will track the normalized signal, and therefore will track the variation of the input voltage signal, a good power factor will be resulted from. If the line voltage is a full-wave rectified result of an AC power and the input voltage signal is fed from the anode of a diode in the LED driver circuit, then not only a good power factor, but also a zero current switching can be provided. The reason is that the voltage at the anode of the diode will start to fall when the current of an inductor in the LED driver circuit discharges to zero, and this will cause the input voltage signal to fall below the threshold signal to activate the first turn-on signal to turn on the NMOS transistor. If the line voltage is a DC voltage and the input voltage signal is fed from the anode of a diode in the LED driver circuit, then power factor correction is not available, but the zero current switching of the NMOS transistor still can be provided.

To make it easier for our examiner to understand the objective of the invention, its structure, innovative features, and performance, we use preferred embodiments together with the accompanying drawings for the detailed description of the invention.

DETAILED DESCRIPTION OF THE PREFERRED EMBODIMENTS

The present invention will be described in more detail hereinafter with reference to the accompanying drawings that show the preferred embodiment of the invention.

Figure 1:
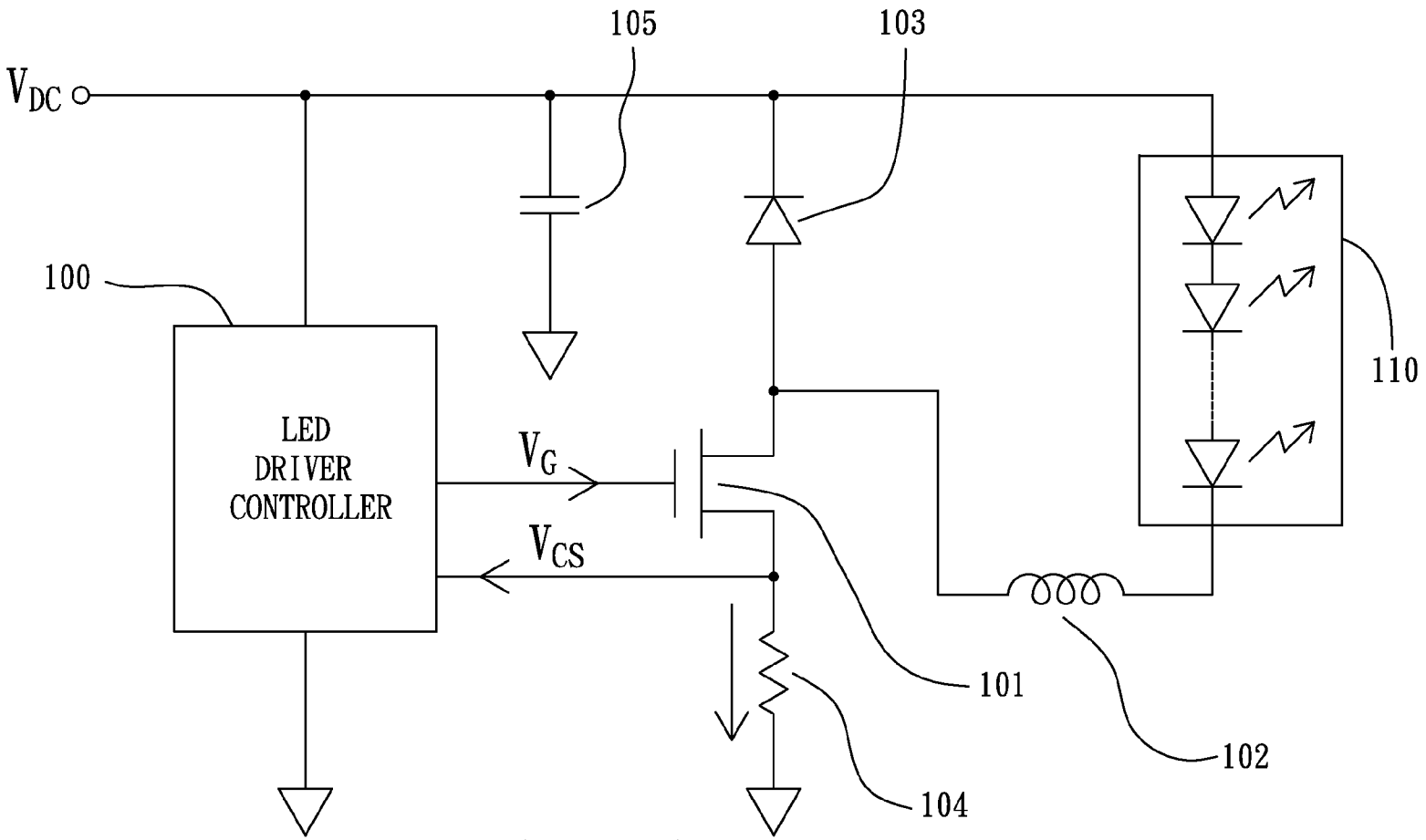
(PRIOR ART) FIG. 1
FIG. 1 illustrates a prior art LED driver circuit.
Figure 2:
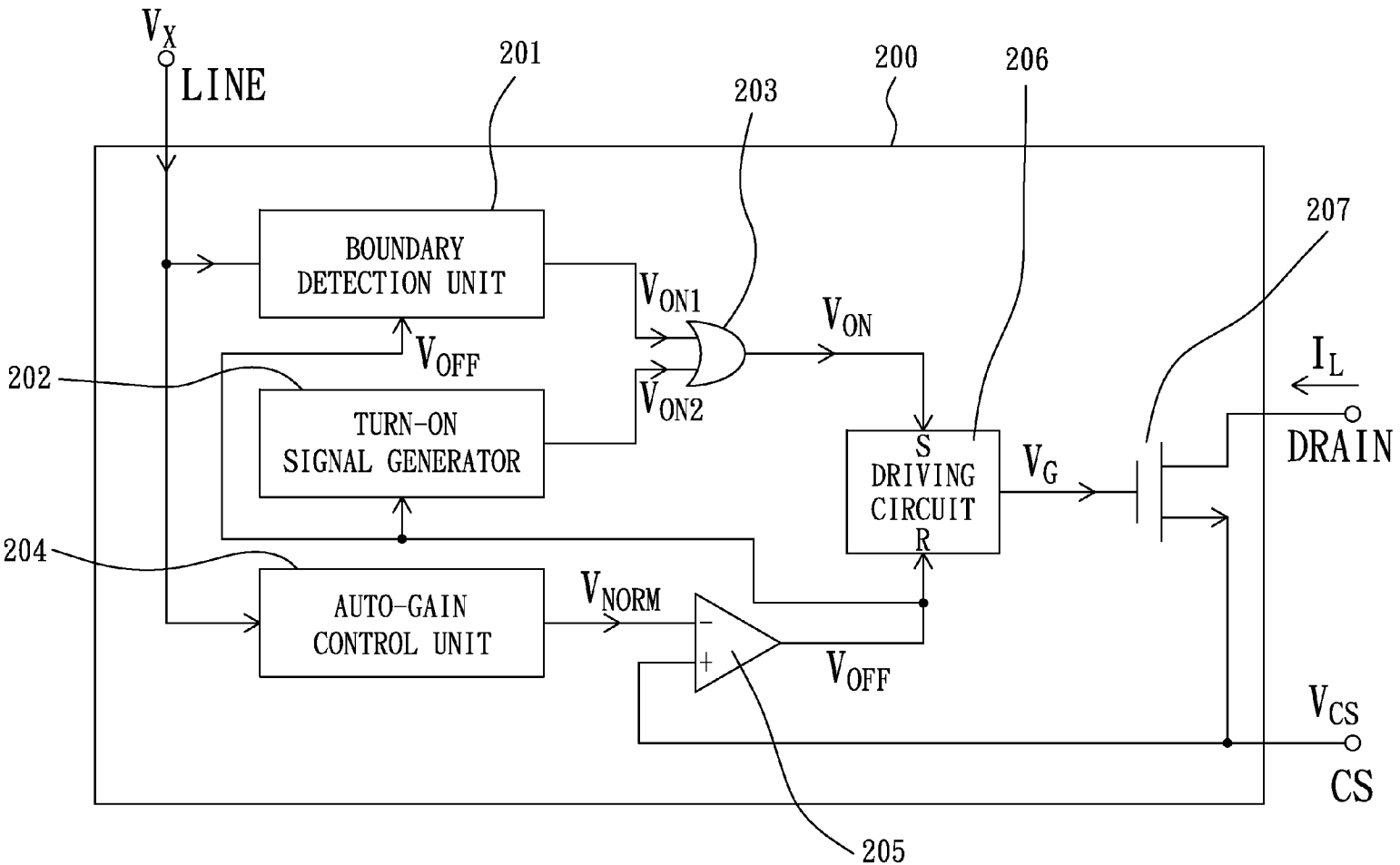
FIG. 2 illustrates the block diagram of a LED driver controller according to a preferred embodiment of the present invention.

Please refer to FIG. 2, which illustrates the block diagram of a LED driver controller according to a preferred embodiment of the present invention. As illustrated in FIG. 2, the LED driver controller 200 includes a boundary detection unit 201, a turn-on signal generator 202, an OR gate 203, an auto-gain control unit 204, a comparator 205, a driving circuit 206, and an NMOS transistor 207.

Figure 3:
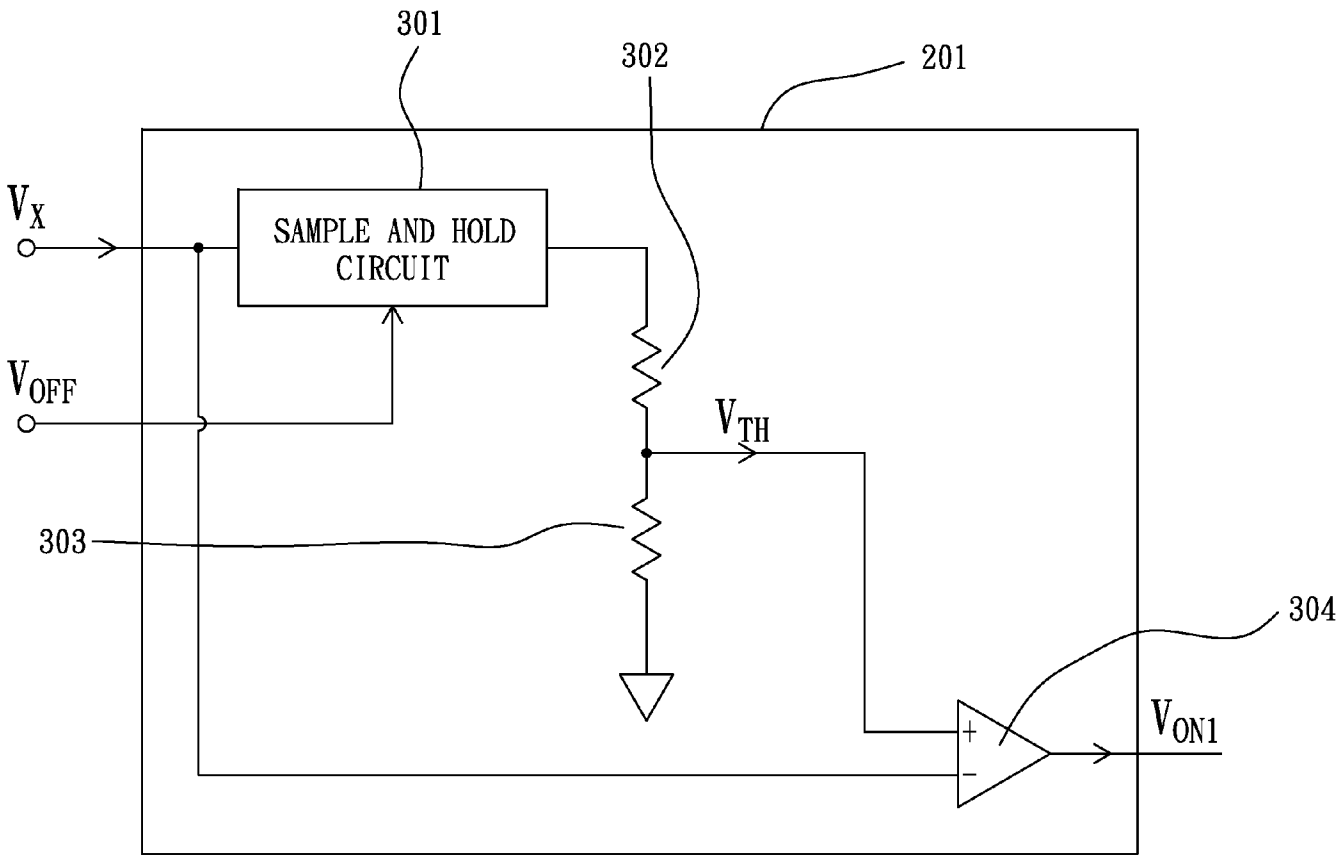
FIG. 3 illustrates the block diagram of a boundary detection unit of the LED driver controller illustrated in FIG. 2 according to a preferred embodiment of the present invention.

The boundary detection unit 201 has an input end coupled to an input voltage signal $V_X$ which is derived from a line voltage, and an output end for providing a first turn-on signal $V_{ON1}$ which is generated according to voltage comparison of the input voltage signal $V_X$ and a threshold signal, wherein the threshold signal is a ratio of a sampled voltage of the input voltage signal $V_X$ at a rising edge of a turn-off signal $V_{OFF}$, and the first turn-on signal $V_{ON1}$ will change state from inactive to active when the input voltage signal $V_X$ falls below the threshold signal. A preferred embodiment of the boundary detection unit 201 is illustrated in FIG. 3, which includes a sample and hold circuit 301, resistors 302~303, and a comparator 304. The sample and hold circuit 301 is used to sample and hold the voltage of the input voltage signal $V_X$ at rising edges of the turn-off signal $V_{OFF}$. The resistors 302~303 are used as a voltage divider to divide the output voltage of the sample and hold circuit 301 to generate a threshold signal $V_{TH}$. The comparator 304 is used to perform voltage comparison on the threshold signal $V_{TH}$ and the input voltage signal $V_X$ to generate the first turn-on signal $V_{ON1}$.

The turn-on signal generator 202 is used to generate a second turn-on signal $V_{ON2}$, which can be a constant-frequency signal or a constant-off-time signal, wherein the constant-off-time signal is generated with reference to the turn-off signal $V_{OFF}$.

The OR gate 203 has a first input end coupled to the first turn-on signal $V_{ON1}$, a second input end coupled to the second turn-on signal $V_{ON2}$, and an output end for providing a turn-on signal $V_{ON}$.

The auto-gain control unit 204 has an input end coupled to the input voltage signal $V_X$, and an output end for providing a normalized signal $V_{NORM}$, wherein the normalized signal $V_{NORM}$ is generated by detecting the amplitude of the input voltage signal $V_X$ and dividing the input voltage signal $V_X$ with the amplitude. As such, the amplitude of the normalized signal $V_{NORM}$ is a constant, no matter what the amplitude of the input voltage signal $V_X$ is.

The comparator 205 is used to perform voltage comparison on the normalized signal $V_{NORM}$ and a current sensing signal $V_{CS}$ to generate the turn-off signal $V_{OFF}$, wherein the turn-off signal $V_{OFF}$ will change state from inactive to active when the current sensing signal $V_{CS}$ reaches the normalized signal $V_{NORM}$.

The driving circuit 206 has a set input end coupled to the turn-on signal $V_{ON}$, a reset input end coupled to the turn-off signal $V_{OFF}$, and an output end for providing a gating signal $V_G$, wherein the gating signal $V_G$ is active when the turn-on signal $V_{ON}$ is active, and inactive when the turn-off signal $V_{OFF}$ is active.

The NMOS transistor 207 has a gate terminal coupled to the gating signal $V_G$, a drain terminal DRAIN for inflow of a load current $I_L$, and a source terminal CS coupled to the current sensing signal $V_{CS}$, wherein the current sensing signal $V_{CS}$ is proportional to the load current $I_L$.

When the LED driver controller 200 of the present invention is operating in a LED driver circuit, the peak of the current sensing signal $V_{CS}$ and therefore the peak of the load current $I_L$ will be regulated at the normalized signal $V_{NO}$. If the line voltage is a full-wave rectified result of an AC power and the input voltage signal $V_X$ is proportional to the line voltage, then as the peak of the load current $I_L$ will track the normalized signal $V_{NO}$, and therefore will track the variation of the input voltage signal $V_X$, a good power factor will be resulted from. If the line voltage is a full-wave rectified result of an AC power and the input voltage signal $V_X$ is fed from the anode of a diode in the LED driver circuit, then not only a good power factor, but also a zero current switching can be provided. The reason is that the voltage at the anode of the diode will start to fall when the current of an inductor in the LED driver circuit discharges to zero, and this will cause the input voltage signal $V_X$ to fall below the threshold signal to activate the first turn-on signal $V_{ON1}$ to turn on the NMOS transistor 207. If the line voltage is a DC voltage and the input voltage signal $V_X$ is fed from the anode of a diode in the LED driver circuit, then power factor correction is not available, but the zero current switching of the NMOS transistor 207 still can be provided.

Figure 4:
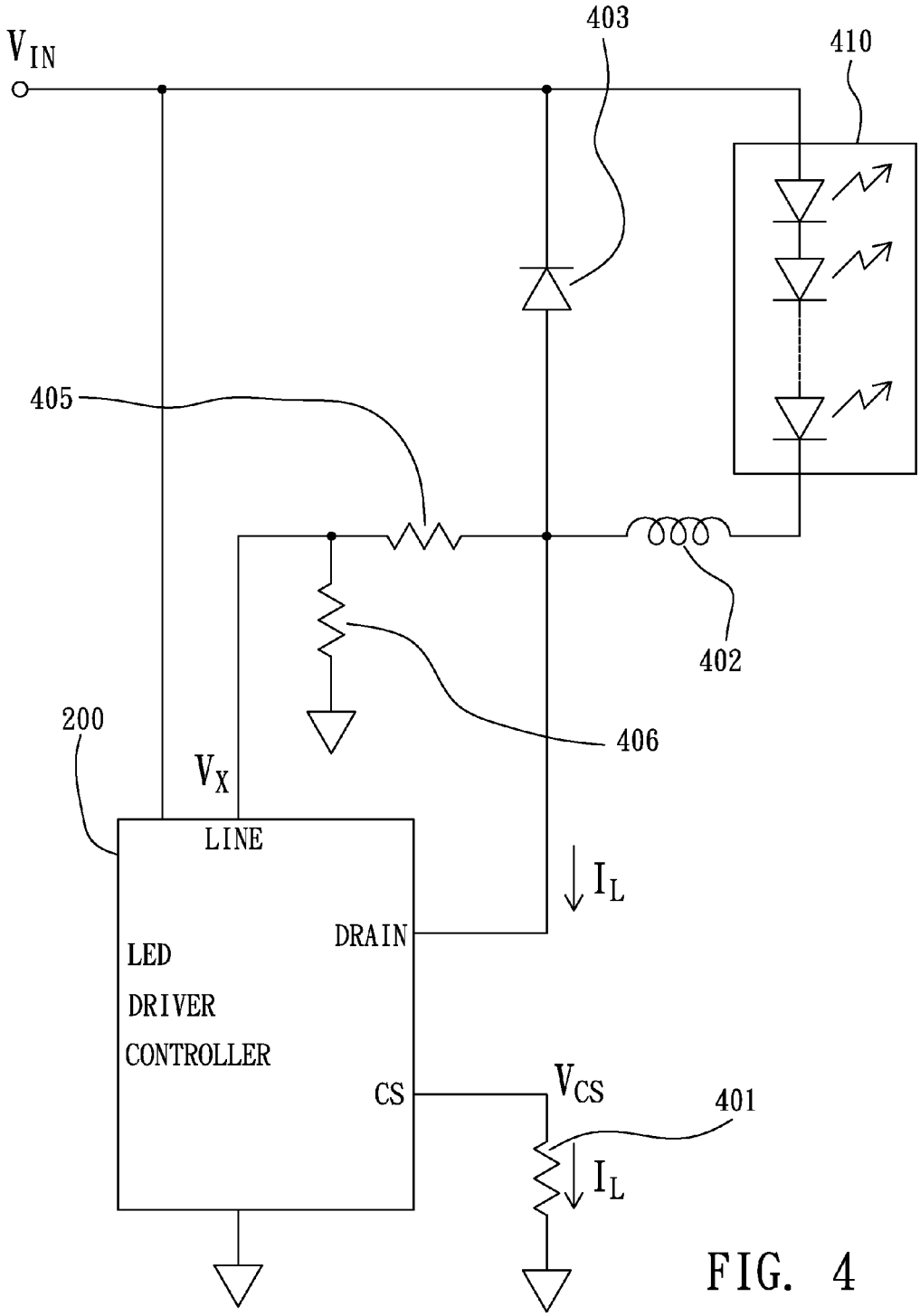
FIG. 4 illustrates the circuit diagram of a LED driver circuit utilizing the LED driver controller illustrated in FIG. 2.

Please refer to FIG. 4, which illustrates the circuit diagram of a LED driver circuit utilizing the LED driver controller illustrated in FIG. 2. As illustrated in FIG. 4, the LED driver circuit includes the LED driver controller 200 illustrated in FIG. 2, a resistor 401, an inductor 402, a diode 403, resistors 405~406, and a LED module 410.

The LED driver controller 200 is biased by a line voltage $V_{IN}$; the input voltage signal $V_X$ is a ratio of the voltage at the anode of the diode 403, caused by the resistor 405 and the resistor 406; the drain terminal DRAIN is coupled to the anode of the diode 403; and the CS terminal is coupled to the resistor 401.

When the LED driver circuit is in operation, the peak of the current sensing signal $V_{CS}$ and therefore the peak of the load current $I_L$ will be regulated at a normalized signal. If the line voltage $Y_{IN}$ is a full-wave rectified result of an AC power, then as the peak of the load current $I_L$ will track the normalized signal, and therefore will track the variation of the input voltage signal $V_X$, a good power factor can be provided. Besides, as the voltage at the anode of the diode 403, and therefore the input voltage signal $V_X$, will start to fall when the current of the inductor 402 discharges to zero, the LED driver controller 200 can also provide a zero current switching by making use of this phenomenon.

Figure 5:
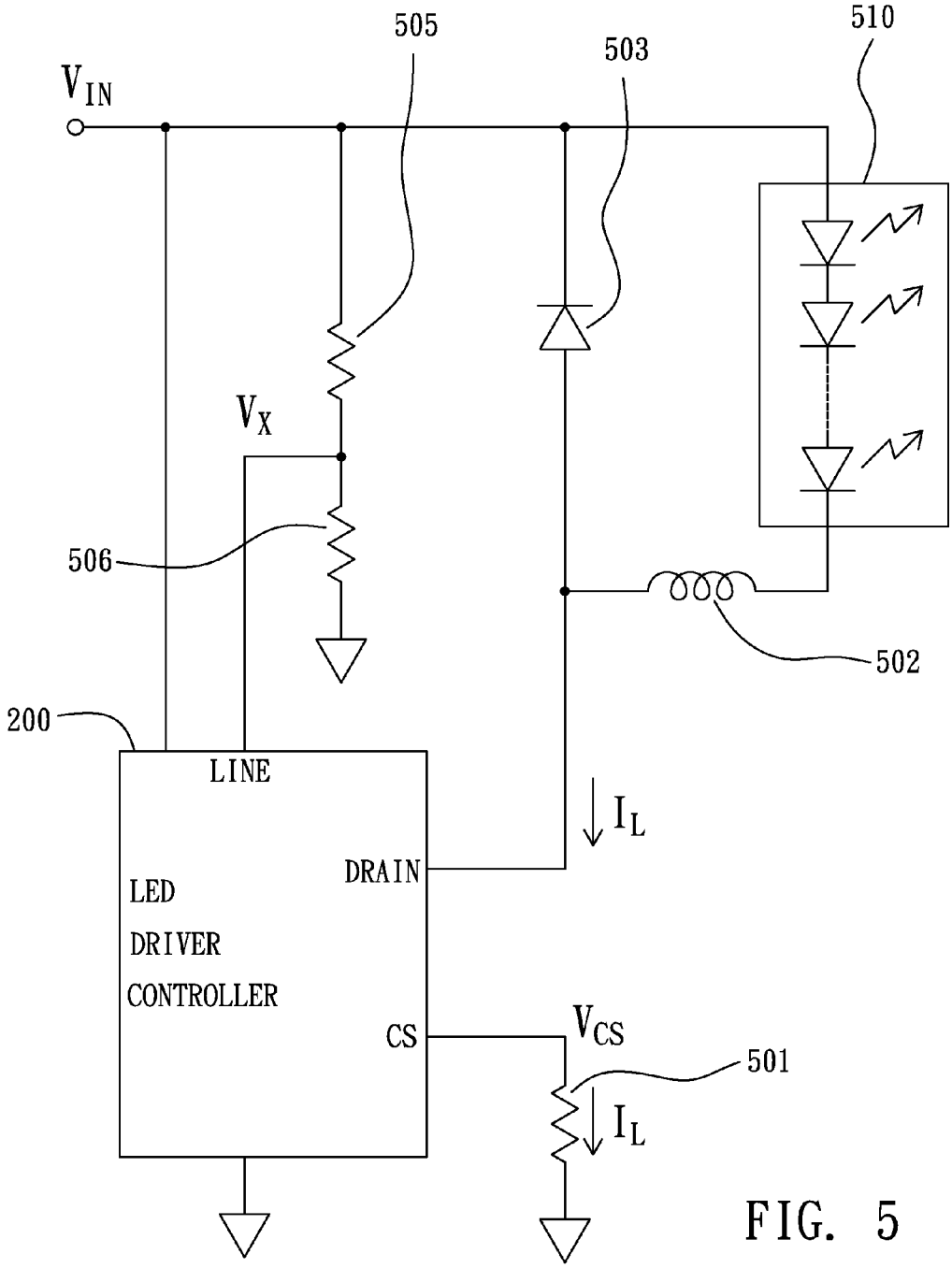
FIG. 5 illustrates the circuit diagram of another LED driver circuit utilizing the LED driver controller illustrated in FIG. 2.

Please refer to FIG. 5, which illustrates the circuit diagram of another LED driver circuit utilizing the LED driver controller illustrated in FIG. 2. As illustrated in FIG. 5, the LED driver circuit includes the LED driver controller 200 illustrated in FIG. 2, a resistor 501, an inductor 502, a diode 503, resistors 505~506, and a LED module 510.

The LED driver controller 200 is biased by a line voltage $V_{IN}$; the input voltage signal $V_X$ is a ratio of the line voltage $Y_{IN}$, caused by the resistor 505 and the resistor 506; the drain terminal DRAIN is coupled to the anode of the diode 503; and the CS terminal is coupled to the resistor 501.

When the LED driver circuit is in operation, the peak of the current sensing signal $V_{CS}$ and therefore the peak of the load current $I_L$ will be regulated at a normalized signal. If the line voltage $Y_{IN}$ is a full-wave rectified result of an AC power, then as the peak of the load current $I_L$ will track the normalized signal, and therefore will track the variation of the input voltage signal $V_X$, a good power factor can be provided.

As can be seen from the specification above, the novel LED driver controller of the present invention not only can regulate the load current but also can provide a power factor correction and/or a zero current switching. Therefore the present invention does improve the prior art LED driver controllers.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

In summation of the above description, the present invention herein enhances the performance than the conventional structure and further complies with the patent application requirements and is submitted to the Patent and Trademark Office for review and granting of the commensurate patent rights.

What is claimed is:

1. An LED driver controller, comprising:

an auto-gain control unit, having a first input end configured to receive an input voltage signal which is derived from a line voltage, and an output end for providing a normalized signal, wherein said normalized signal is generated by detecting the amplitude of said input voltage signal and dividing said input voltage signal with said amplitude;

a first comparator, used to perform voltage comparison on said normalized signal and a current sensing signal to generate a turn-off signal, wherein said turn-off signal will change state from inactive to active when said current sensing signal reaches said normalized signal;

a driving circuit, having a second input end, a third input end, and an output end, said second input end configured to receive a first turn-on signal, said third input end being configured to receive said turn-off signal, and said output end being used for providing a gating signal, wherein said gating signal is active when said first turn-on signal is active, and inactive when said turn-off signal is active;

a boundary detection unit, having a fourth input end which receives said input voltage signal, and an output end which generates a second turn-on signal which is generated by comparing said input voltage signal and a first threshold signal, wherein said first threshold signal is proportionate to a sampled voltage of said input voltage signal at a rising edge of said turn-off signal, and said second turn-on signal will change state from inactive to active when said input voltage signal falls below said first threshold signal;

a turn-on signal generator, used to generate a third turn-on signal, which is a signal selected from the group consisting of a constant-frequency signal and a constant-off-time signal; and an OR gate, having a fifth input end configured to receive said second turn-on signal, a sixth input end configured to receive said third turn-on signal, and an output end for outputting said third turn-on signal.

2. The LED driver controller of claim 1, further comprising an NMOS transistor, having a gate terminal configured to receive said gating signal, a drain terminal for inflow of a load current provided by said line voltage, and a source terminal configured to receive said current sensing signal, wherein said current sensing signal is proportional to said load current.

3. The LED driver controller of claim 2, wherein said boundary detection unit comprises:

a sample and hold circuit, used to sample and hold the voltage of said input voltage signal at rising edges of said turn-off signal;

a voltage divider, used to divide the output voltage of said sample and hold circuit to generate a second threshold signal; and a second comparator, used to perform voltage comparison on said second threshold signal and said input voltage signal to generate said first turn-on signal.

4. The LED driver controller of claim 3, wherein said line voltage is a full-wave rectified signal.

5. The LED driver controller of claim 4, wherein said input voltage signal is proportionate to said line voltage.

6. The LED driver controller of claim 4, wherein said input voltage signal is proportionate to the voltage at the anode of a diode in a LED driver circuit.

7. An LED driver controller, comprising:

an auto-gain control unit, having a first input end configured to receive an input voltage signal which is derived from a line voltage, and an output end for providing a normalized signal, wherein said normalized signal is generated by detecting the amplitude of said input voltage signal and dividing said input voltage signal with said amplitude;

a first comparator, used to perform voltage comparison on said normalized signal and a current sensing signal to generate a turn-off signal, wherein said turn-off signal will change state from inactive to active when said current sensing signal reaches said normalized signal;

a driving circuit, having a second input end, a third input end, and an output end, said second input end configured to receive a turn-on signal, said third input end configured to receive said turn-off signal, said output end configured to provide a gating signal, wherein said gating signal is active when said turn-on signal is active, and inactive when said turn-off signal is active;

a boundary detection unit, having a fourth input end configured to receive said input voltage signal, and an output end configured to output a first turn-on signal which is generated according to voltage comparison of said input voltage signal and a first threshold signal, wherein said first threshold signal is proportionate to a sampled voltage of said input voltage signal at a rising edge of said turn-off signal, and said first turn-on signal will change state from inactive to active when said input voltage signal falls below said first threshold signal;

a turn-on signal generator, used to generate a second turn-on signal, which is a signal selected from the group consisting of a constant-frequency signal and a constant-off-time signal;

an OR gate, having a fifth input end configured to receive said first turn-on signal, a sixth input end configured to receive said second turn-on signal, and an output end configured to output said second turn-on signal; and an NMOS transistor, having a gate terminal configured to receive said gating signal, a drain terminal for inflow of a load current provided by said line voltage, and a source terminal configured to output said current sensing signal, wherein said current sensing signal is proportional to said load current.

8. The LED driver controller of claim 7, wherein said boundary detection unit comprises:

a sample and hold circuit, used to sample and hold the voltage of said input voltage signal at rising edges of said turn-off signal;

a voltage divider, used to divide the output voltage of said sample and hold circuit to generate a second threshold signal; and a second comparator, used to perform voltage comparison on said second threshold signal and said input voltage signal to generate said first turn-on signal.

9. The LED driver controller of claim 8, wherein said input voltage signal is proportionate to the voltage at the anode of a diode in a LED driver circuit.

* * * * *